US006755253B2

(12) United States Patent
Smith et al.

(10) Patent No.: US 6,755,253 B2
(45) Date of Patent: Jun. 29, 2004

(54) PRESSURE CONTROL SYSTEM FOR A WET CONNECT/DISCONNECT HYDRAULIC CONTROL LINE CONNECTOR

(75) Inventors: Robert C. Smith, Aberdeen (GB); William D. Ritchie, Aberdeen (GB); Graeme Falconer, Aberdeen (GB); Steve G. Hall, Alford (GB); Stan A. Ralph, Aberdeen (GB); Steve Johnstone, Aberdeen (GB)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/317,558

(22) Filed: Dec. 12, 2002

(65) Prior Publication Data

US 2003/0173077 A1 Sep. 18, 2003

Related U.S. Application Data

(60) Provisional application No. 60/342,722, filed on Dec. 19, 2001.

(51) Int. Cl.[7] ..... E21B 34/10

(52) U.S. Cl. ..... 166/338; 166/386; 166/319

(58) Field of Search ..... 166/338, 340, 166/344, 386, 387, 319, 324, 334.4

(56) References Cited

U.S. PATENT DOCUMENTS

| | | | | |
|---|---|---|---|---|
| 4,373,767 A | | 2/1983 | Cairns | 339/94 |
| 4,723,230 A | | 2/1988 | Chelminski | 367/20 |
| 5,238,070 A | * | 8/1993 | Schultz et al. | 166/386 |
| 5,482,119 A | * | 1/1996 | Manke et al. | 166/374 |
| 6,349,767 B2 | * | 2/2002 | Gissler | 166/242.6 |
| 6,349,772 B2 | * | 2/2002 | Mullen et al. | 166/387 |
| 6,595,296 B1 | * | 7/2003 | French | 166/375 |

FOREIGN PATENT DOCUMENTS

| | | |
|---|---|---|
| EP | 0 313 374 | 10/1988 |
| EP | 0 417 369 | 9/1989 |
| EP | 0 860 583 | 8/1998 |
| FR | 2 522 059 | 8/1983 |

* cited by examiner

*Primary Examiner*—Frank Tsay
(74) *Attorney, Agent, or Firm*—Cantor Colburn LLP

(57) ABSTRACT

A pressure control system for a wet connect/disconnect hydraulic control line connector includes a reservoir and a piston in said reservoir. The reservoir contains hydraulic fluid or equivalent and the piston is biased by hydrostatic pressure or an atmospheric chamber and hydrostatic pressure. Pressure in the hydraulic line being controlled by the system is controllable based upon the existence or lack of an atmospheric chamber and its placement. The method for controlling pressure in a hydraulic control line wet connector includes running the control system and biasing the piston to control pressure.

12 Claims, 6 Drawing Sheets

PRESSURE CONTROL SYSTEM FOR A WET CONNECT/DISCONNECT HYDRAULIC CONTROL LINE CONNECTOR

CROSS REFERENCE TO RELATED APPLICATIONS

This application claims the benefit of an earlier filing date from U.S. Provisional Application Serial No. 60/342,722 filed Dec. 19, 2001, the entire disclosure of which is incorporated herein by reference.

BACKGROUND

Control of tools in the downhole environment and transmission of information between different points of the same has been both a point of great success and a conundrum for many years. Methods for control of the tools and the transmission of information continue to progress and with that progression comes new problems and issues associated with such control and communication. Methods and apparatus capable of enhancing the quality of such communications have historically included hydraulic line. More recently, electric conductors have been employed and most recently the industry has worked to create optic fiber assemblies capable of withstanding the harsh downhole environment in order to take advantage of the speed and accuracy of communications with optic fibers as well as the opportunity to use the fiber as a sensory device. There has been great success achieved in the area. Moreover, evermore tools and sensors are being used in the downhole arena. These require control and communication and employ all of hydraulic control lines, electronic conductors and optic fibers.

As the technology becomes more ubiquitous, the ability to manufacture and install such communication pathways competitively becomes increasingly important.

While it has been demonstrated that the communications conduit noted can be successfully installed in a wellbore during completion thereof, there has been little done with respect to "wet" connections of lengths of these conduits.

SUMMARY

A pressure control system for a wet connect/disconnect hydraulic control line connector includes a reservoir and a piston in said reservoir. The reservoir contains hydraulic fluid or equivalent and the piston is biased by hydrostatic pressure or an atmospheric chamber (or selected pressure chamber) and hydrostatic pressure. Pressure in the hydraulic line being controlled by the system is controllable based upon the existence or lack of an atmospheric chamber and its placement. The method for controlling pressure in a hydraulic control line wet connector includes running the control system and biasing the piston to control pressure.

BRIEF DESCRIPTION OF THE DRAWINGS

Referring now to the drawings wherein like elements are numbered alike in the several Figures.

DETAILED DESCRIPTION

Figure 1:
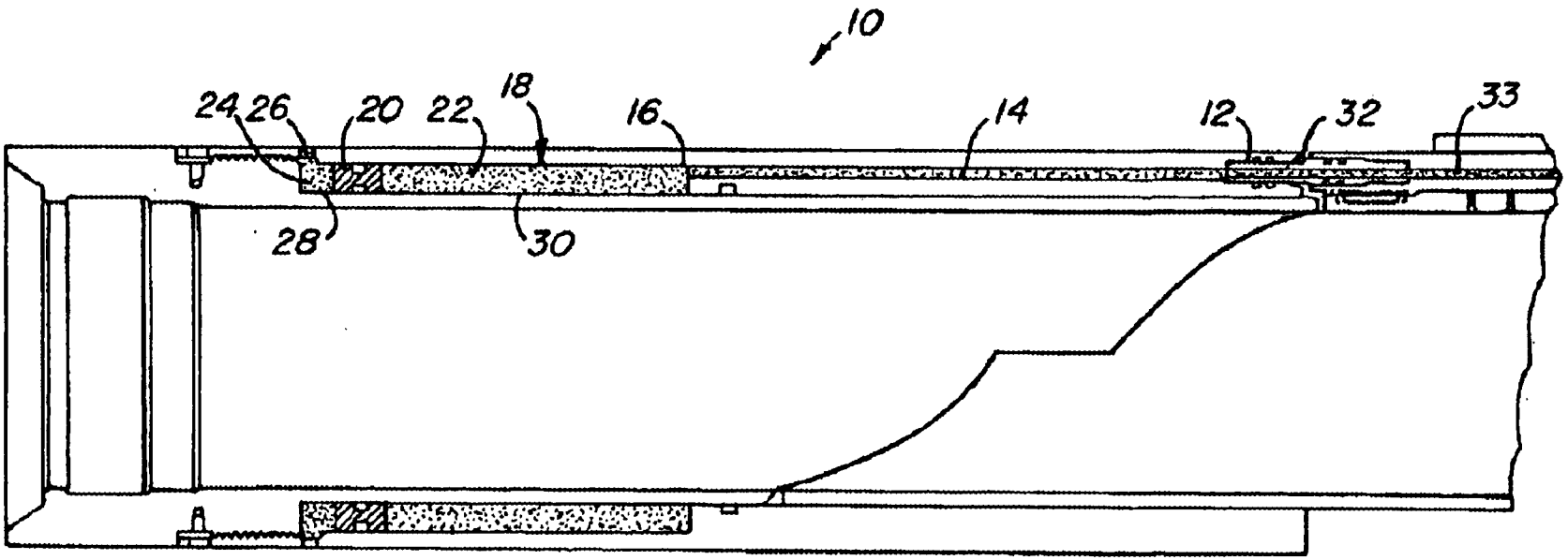
FIG. 1 is a cross-sectional view of a first embodiment of the pressure compensation system.

Referring to FIG. 1, a balanced piston embodiment is illustrated. The system, indicated generally at 10, comprises a female connector discussed herein as a mating profile 12 (available commercially as a "wear bushing connector" from Baker Oil Tools, Houston, Tex.) in fluid communication with a drill hole 14 (any type of conduit is acceptable providing it is capable of conveying fluid and pressure as disclosed herein), which is in fluid communication with one end 16 of a hydraulic fluid reservoir 18. A piston 20 is positioned within reservoir 18 and separates hydraulic fluid 22 in reservoir 18 from wellbore fluid 24 which may move into and out of reservoir 18 through port 26 depending upon a pressure gradient between the hydraulic fluid and wellbore fluid. When wellbore fluid pressure is increased, for example due to an increase in the depth at which the tool is positioned, region 28 of reservoir 18 expands and region 30 of reservoir 18 is made smaller by movement of piston 20. Fluid 22 within region 30 is urged to move into hole 14 to increase the pressure thereof to match hydrostatic pressure. By so configuring the system, the pressure of the hole 14 (and any conduit in fluid communication therewith, e.g. line 33) including all connections thereof can be maintained at a pressure substantially equaling ambient hydrostatic wellbore pressure at any given depth effectively reducing stress upon such components and lengthening the anticipated working lives thereof. Piston 20 prevents transfer of wellbore fluids to region 30 of reservoir 18 thus preventing infiltration of wellbore fluids into the hydraulic conduit 14, 33 which would otherwise be detrimental thereto.

Furthermore, hydraulic fluid 22, which of course is the same fluid through hole 14, connector 32 and hydraulic line 33 extending to a downhole location, is at the same pressure as ambient wellbore pressure. Thus it is not likely wellbore fluid will enter the line 33 through connector 32 when system 10 is removed.

Figure 2:
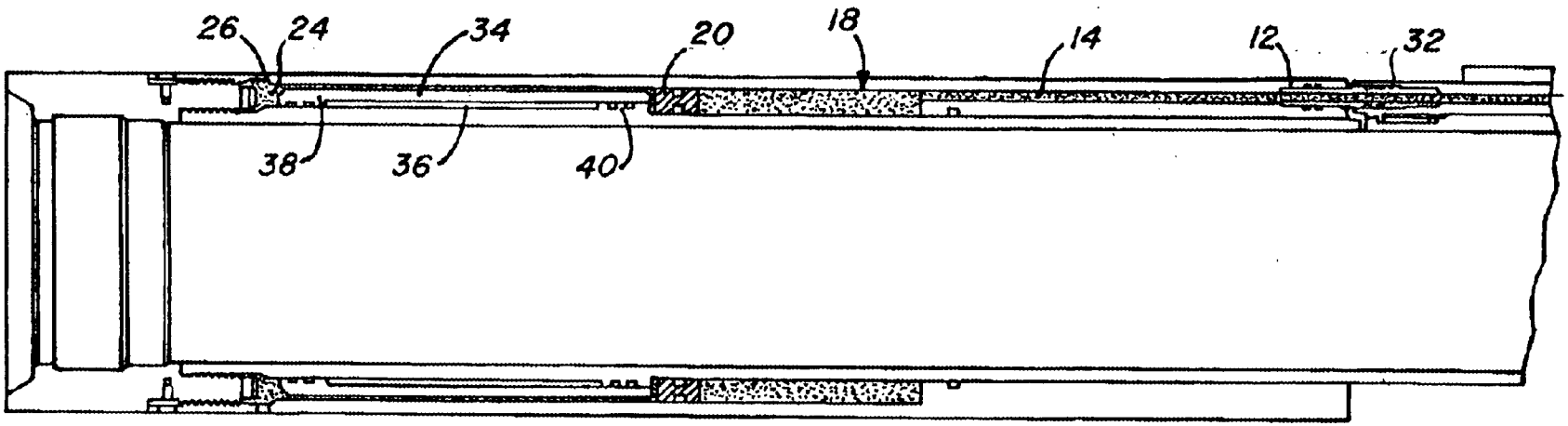
FIG. 2 is a cross-sectional view of a second embodiment of the pressure compensation system.

In a second embodiment, referring to FIG. 2, reservoir 18, piston 20 and port 26 are identical to the foregoing embodiment. Distinct however, is an augmenting piston 34 that defines an atmospheric chamber 36. It is noted that although several embodiments herein refer to an "atmospheric" chamber, a selected pressure chamber having any particular pressure therein can be substituted with commensurate changes in the cumulative effect of the system. While wellbore fluid 24 acts upon piston 34 similarly as it did upon piston 20 in the foregoing embodiment, in this embodiment piston 20 is acted upon by both wellbore fluid 24 and piston 34. Piston 34 has increased impetus to move from atmospheric chamber 36, which when in an environment having a pressure greater than atmospheric functions like a vacuum and draws piston seal flange 38 toward mandrel seal flange 40. Since both forces act in concert the pressure created in reservoir 18 is in excess of ambient wellbore (hydrostatic) pressure. This is desirable in some applications because upon removing system 10 from connector 32, the excess pressure in hydraulic pathway will cause an expression of fluid from connector 32. The fluid tends to clear any debris from the end of connector 32 and additionally creates a bubble of clean hydraulic fluid around the same, which assists in keeping connector 32 clear of debris.

Figure 3:
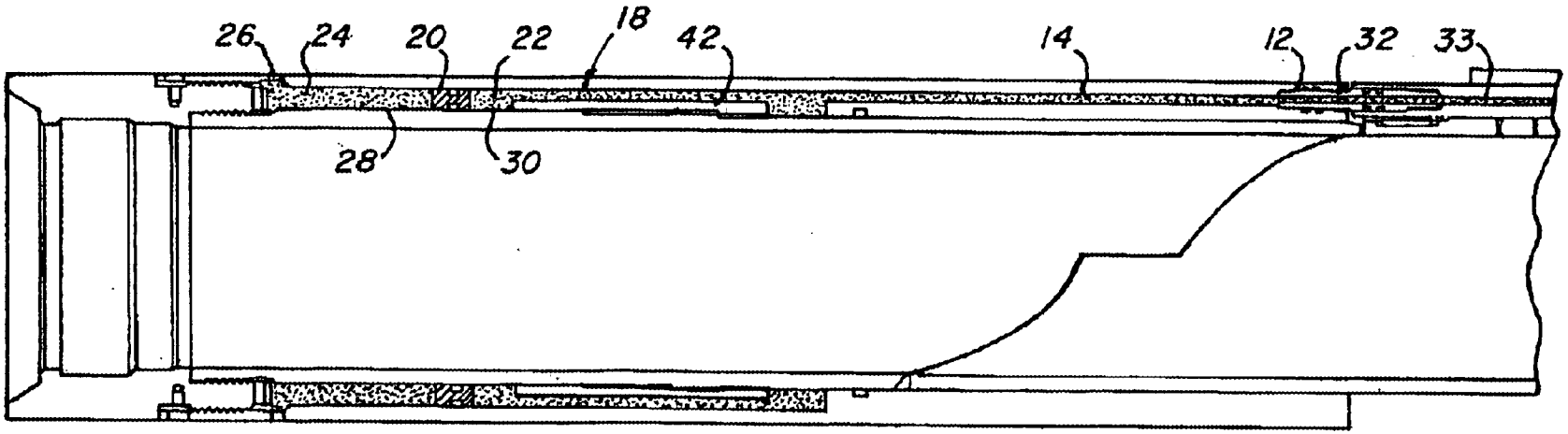
FIG. 3 is a cross-sectional view of a third embodiment of the pressure compensation system.

Referring to FIG. 3, another embodiment is illustrated. This embodiment is intended to limit the depth up to which the pressure inside reservoir 18 and hydraulic conduit 14, 33 may be increased by ambient wellbore pressure. It will be appreciated that this figure is identical to FIG. 1 except for the addition of stop collar 42 placed within reservoir 18. With stop collar 42 in place, it will be understood that piston 20 can only be urged so far to the right (in the figure) by ambient wellbore pressure entering region 28 of reservoir 18 through port 26. In this embodiment pressure in reservoir 18 and hole 14 (and therefore line 33) will be maintained at ambient wellbore pressure until the pressure of the wellbore (usually due to depth) increases to a degree beyond that which would have moved piston 20 into contact with stop collar 42. With increasing pressure beyond the pressure at which piston 20 will hard stop against stop collar 42, the pressure in region 30 of reservoir 18 and in hole 14 will begin to be less than ambient wellbore pressure. This is useful if a reduced pressure relative to ambient pressure is desirable in hydraulic conduit 14, 33 for a particular application. One such application where the discussed result is useful is where the wellbore fluid is to be changed to a lighter fluid prior to removing the cover (wear bushing: commercially available from Baker Oil Tools, Houston, Tex.) from connector 32.

In yet another embodiment, referring to FIG. 4, an active approach is taken to maintain the pressure in reservoir 18 and hole 14 at a selected amount below ambient pressure. This embodiment employs a compensation piston 50 having a piston seal flange 52 located more toward hole 14 than mandrel seal flange 54. Between flanges 52 and 54 is defined an atmospheric chamber 56. Upon ingress of wellbore fluid 24 through port 26, piston 20 is urged toward hole 14, which necessarily causes atmospheric chamber 56 to expand in volume without a complementary increase in pressure. In such situations it will be appreciated that atmospheric chamber 52 will have less than atmospheric pressure therein commensurate with the amount of volumetric increase of the chamber. Therefore, the more the hydrostatic pressure based force expands the chamber in volume the more there is a complementary decrease in pressure. Stated differently, the more pressure based force is exerted against piston 20 by the wellbore fluid 24, the more counterforce is exerted by compensation piston 50 due to the increasing volume (and consequently decreasing pressure) in "atmospheric" chamber 56. The atmospheric chamber 56 is energized by the reservoir pressure. Because of the atmospheric chamber 56 working against the wellbore pressure, the pressure in reservoir 18 and hydraulic conduit 14, 33 will remain below hydrostatic (ambient) wellbore pressure by a calculable amount commensurate with depth of the system.

Figure 4:
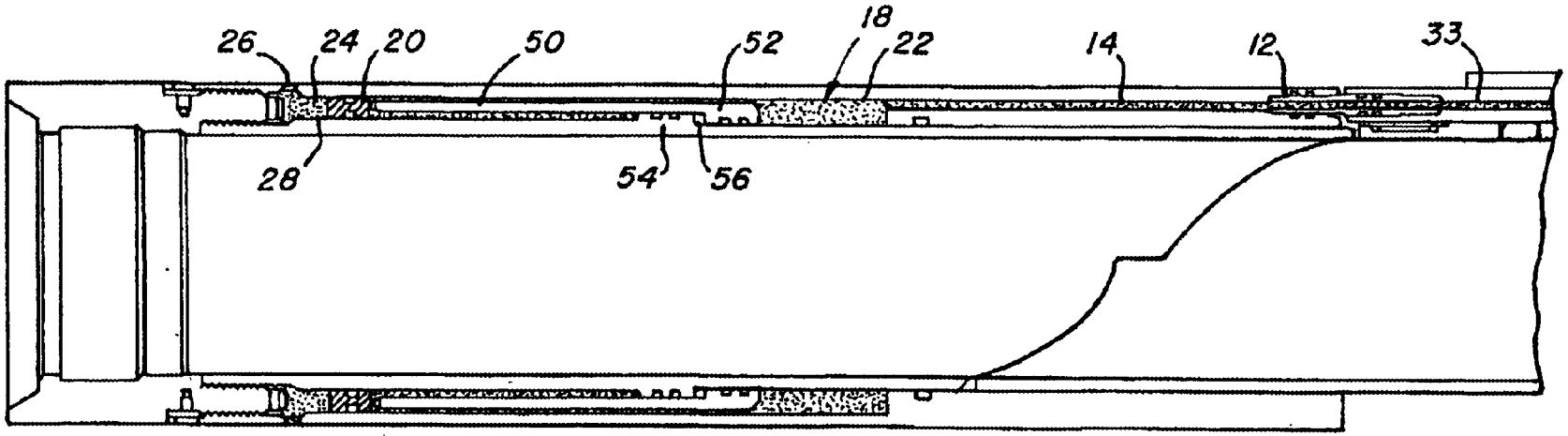
FIG. 4 is a cross-sectional view of a fourth embodiment of the pressure compensation system.
Figure 5:
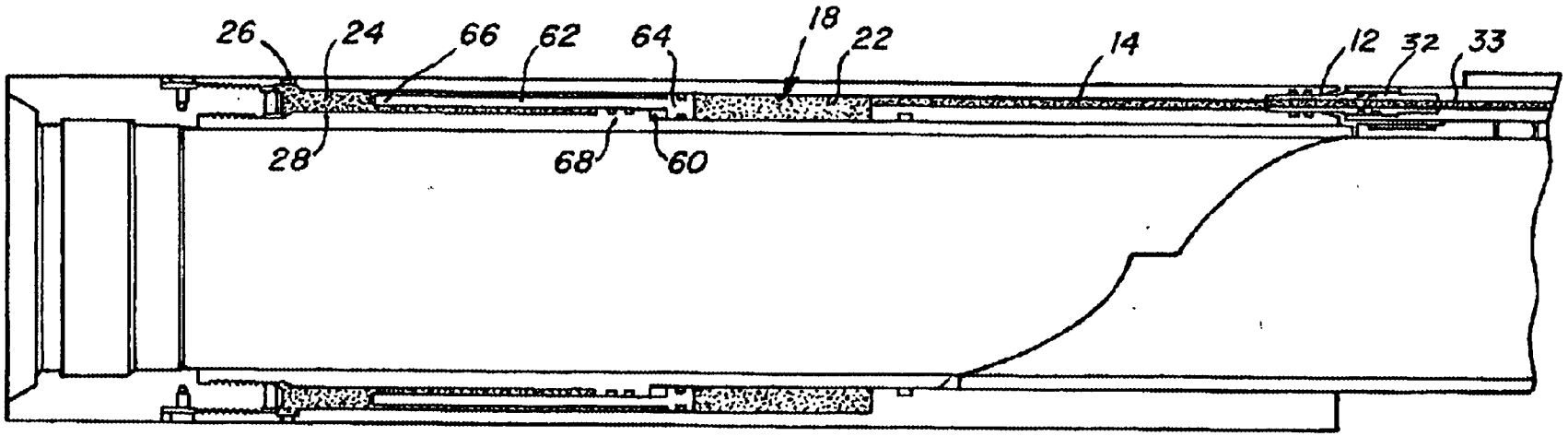
FIG. 5 is a cross-sectional view of a fifth embodiment of the pressure compensation system.
Figure 7:
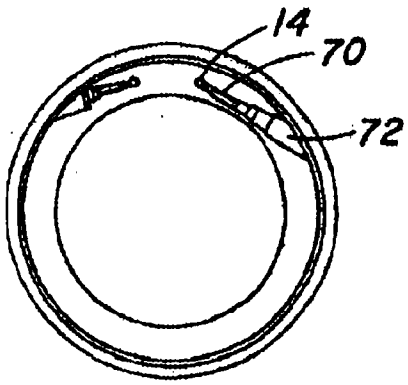
FIGS. 6 and 7 are illustrative of an embodiment with a relief valve therein.
Figure 6:
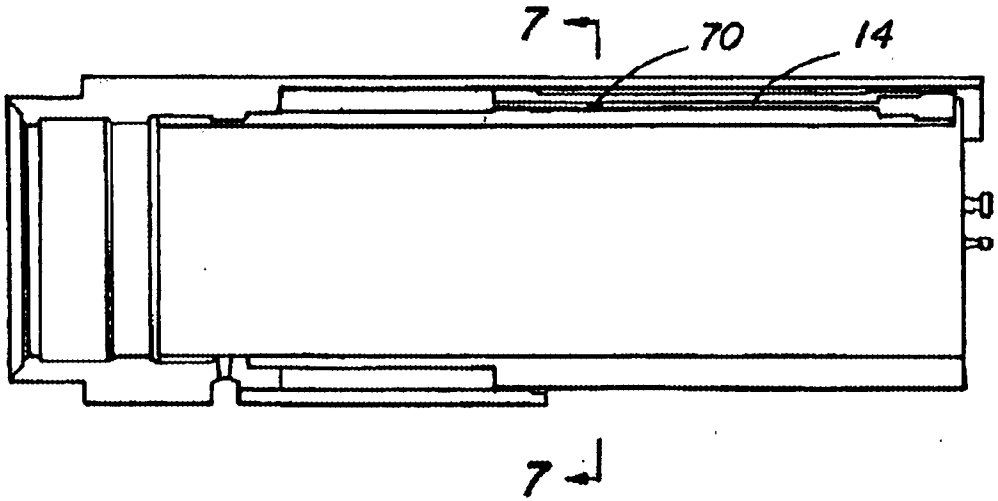

In a final embodiment, referring to FIG. 5, the embodiment of FIG. 4 is adjusted to provide for a more pronounced wellbore pressure-to-reservoir pressure differential. The distinction is achieved by removing the atmospheric chamber 60 to the wellbore side of reservoir 18, or region 28. In this embodiment, piston 20 from prior embodiments is omitted and compensation piston 62 includes a seal piston 64 on the reservoir contact end thereof. Atmospheric chamber 60 is defined between piston 64 and mandrel seal flange 68. Compensation piston 62 is open on its other end 66 to wellbore fluid 24 and the pressure thereof through port 26. As implied this arrangement results in a pressure in reservoir 18 and hydraulic conduit 14, 33 lower than hydrostatic (ambient) pressure Referring now to FIGS. 6 and 7 one will appreciate the incorporation of a relief valve 70. A relief valve may be incorporated in each of the foregoing embodiments as desired to accommodate expansion of the hydraulic fluid due to elevated downhole temperatures. Valve 70 is an automatic pressure relief valve configured to relieve pressure at a selected valve. Such valves are commercially available from the Lee Company, a well known commercial supplier.

Relief valve 70 extends from a recess 72 in an outside dimension of the tool to hole 14 in the body of the tool. This provides a fluid pathway for escape of overpressurized hydraulic fluid in hole 14 such that other components of the system such a seals are not damaged by overpressurization.

While preferred embodiments have been shown and described, modifications and substitutions may be made thereto without departing from the spirit and scope of the invention. Accordingly, it is to be understood that the present invention has been described by way of illustrations and not limitation.

What is claimed is:

1. A pressure control system for a wet connect hydraulic control line connector comprising:

a hydraulic fluid reservoir open at one end to ambient pressure and connected at another end to a conduit terminating in a connector; and a piston in said reservoir between said end open to ambient pressure and said end connected to said conduit.

2. A pressure control system for a hydraulic control line as claimed in claim 1 wherein said system further defines a selected pressure chamber.

3. A pressure control system for a hydraulic control line as claimed in claim 2 wherein said selected pressure chamber biases said piston toward said end connected to said conduit when said system is exposed to an ambient pressure exceeding the selected pressure.

4. A pressure control system for a hydraulic control line as claimed in claim 2 wherein said selected pressure chamber biases said piston toward said end open to ambient pressure when said system is exposed to an ambient pressure exceeding the selected pressure.

5. A pressure control system for a hydraulic control line as claimed in claim 1 wherein said system further includes a compensation piston biased by a selected pressure chamber.

6. A pressure control system for a hydraulic control line as claimed in claim 5 wherein said bias is to increase pressure in said reservoir.

7. A pressure control system for a hydraulic control line as claimed in claim 5 wherein said bias is to decrease pressure in said reservoir.

8. A pressure control system for a hydraulic control line as claimed in claim 5 wherein said selected pressure chamber is within said reservoir.

9. A pressure control system for a hydraulic control line as claimed in claim 5 wherein said selected pressure chamber is outside said reservoir.

10. A pressure control system for a hydraulic control line as claimed in claim 2 wherein said selected pressure chamber is an atmospheric chamber.

11. A pressure control system for a hydraulic control line as claimed in claim 1 wherein said system further includes a pressure relief valve.

12. A pressure control system for a hydraulic control line as claimed in claim 11 wherein said valve is configured to vent pressure to an outside of said system.

* * * * *